US005341528A

United States Patent [19]

Sultzbaugh

[11] Patent Number: 5,341,528

[45] Date of Patent: Aug. 30, 1994

[54] FOOT REST FOR USE IN A SHOWER

[76] Inventor: Caroline Sultzbaugh, 6426 Woodland Dr., Dallas, Tex. 75225

[21] Appl. No.: 29,450

[22] Filed: Mar. 11, 1993

[51] Int. Cl.[5] ..... A47K 3/022

[52] U.S. Cl. ..... 4/611; 4/574.1

[58] Field of Search ..... 4/574.1, 604, 611, 605, 4/612, 614, 571.1, 578.1

[56] References Cited

U.S. PATENT DOCUMENTS

| | | | |
|---|---|---|---|
| 62,167 | 2/1867 | Van Hagen | 4/578.1 |
| 1,232,223 | 7/1917 | Clarke | 4/574.1 |
| 2,456,174 | 12/1948 | Clark | 4/574.1 |
| 2,818,577 | 1/1958 | Kubik et al. | 4/611 |
| 3,193,848 | 7/1965 | Levy | 4/611 |
| 3,275,283 | 9/1966 | Rauch | 4/611 X |
| 3,396,413 | 8/1968 | Kaufman | 4/574.1 |
| 4,489,448 | 12/1984 | Cairo | 4/611 X |
| 4,727,606 | 3/1988 | Cavey et al. | 4/611 |
| 4,951,327 | 8/1990 | Del Gorio | 4/498 |

FOREIGN PATENT DOCUMENTS

| | | | |
|---|---|---|---|
| 0185391 | 1/1937 | Switzerland | 4/611 |

*Primary Examiner*—Charles E. Phillips

*Attorney, Agent, or Firm*—Jones, Day, Reavis & Pogue

[57] ABSTRACT

A foot rest comprising an elongated body portion presenting opposed ends having a general cross-sectional shape of a right-angle triangle for placement in a corner of a shower stall such that the hypotenuse of the triangular cross section forms a front wall of the body portion is disclosed. One of the opposed ends forms an endmost bottom section for resting on a floor of a shower stall, the bottom section generally conforming to the slope of the shower stall floor such that the body portion generally stands perpendicular to horizontal when placed in the stall. The other opposed end forms a generally planar top section for allowing a user to rest a foot thereon.

6 Claims, 1 Drawing Sheet

FOOT REST FOR USE IN A SHOWER

BACKGROUND OF THE INVENTION

1. Field of the Invention

The present invention relates to a foot rest for use in a shower.

2. Description of the Related Art

Most shower stalls in use today simply consist of four vertical walls and the floor of the shower stall. There is a general lack of any essentially horizontal surfaces which would be convenient for a user to place his or her foot upon while showering. Especially in regards to a lady who shaves her legs during the shower, such a foot resting surface would be quite desirable.

This problem has been dealt with in the past. For example, the patent to Levy, U.S. Pat. No. 3,193,848, discloses a shower seat which fits into the corner of a shower stall and has a hinged top which rotates upwardly such that the seat portion can be moved to an out-of-the-way position. This shower seat is disclosed as being a horizontal surface and is attached to shower stall walls via suction cups.

Another patent to Cairo, U.S. Pat. No. 4,489,448, discloses a foot support for showers. This foot support consists of four supporting legs in a horizontally mounted top portion having a V-shaped prow end which fits into the corner of most shower stalls. The upper surface further includes numerous depressions and indentations formed to follow the contours of the prints of both left and right feet.

Another patent to Kubik et al., U.S. Pat. No. 2,818,577, discloses a foot support for shower baths. The foot support includes an upper flat surface with a telescoping tube connected thereto and a base portion which fits in one corner of the shower with the tube extending diagonally across the shower and the edge of the foot support bearing against the opposite wall of the shower.

The patent to Rauch, U.S. Pat. No. 3,275,283, discloses a foot rest which is to be held and secured within a wall of the shower stall. The foot rest includes a pivoting frame which a user pivots outwardly then rests her foot thereon.

Finally, the patent to Cavey et al., U.S. Pat. No. 4,727,606, discloses a bathroom accessory which hangs from a wall of the shower and includes legs which pivot outwardly from the accessory for supporting a bather's foot or body.

SUMMARY OF THE INVENTION

The present invention provides a foot rest for use in a shower. The foot rest comprises an elongated body portion having a generally cross-sectional shape of a right-angle triangle for placement in a corner of a shower stall such that the hypotenuse of the triangular cross section forms a front wall of the body portion. One of the ends of the body portion forms an endmost bottom section for resting on the floor of the shower stall wherein the bottom section generally conforms to the slope of the shower stall floor such that the body portion generally stands perpendicular to horizontal when placed in the shower stall. The other end of the body portion forms a generally planar top section for allowing the user to rest a foot thereon.

It is therefore an object of the present invention to provide a foot rest for use in a shower which presents a sloping bottom portion which conforms to the slope of the shower stall floor so that the foot rest stands erect.

Another object of the present invention is to provide a foot rest with a nonskid sloping top surface for providing a comfortable position on which to rest one's foot while washing or shaving one's leg.

It is a further object of the present invention that the top section overhangs the front wall of the foot rest to form a lip which acts as a handle for lifting the foot rest.

It is a still further object of the present invention to provide at least one shelf unit for storing toiletry items within the body portion wherein the shelf unit is accessible through an aperture in the back wall of the body portion.

BRIEF DESCRIPTION OF THE DRAWINGS

These and other objects of the present invention will be more fully understood in conjunction with the accompanying drawings in which like numbers indicate like components and in which.

DESCRIPTION OF THE PREFERRED EMBODIMENT

Figure 1:
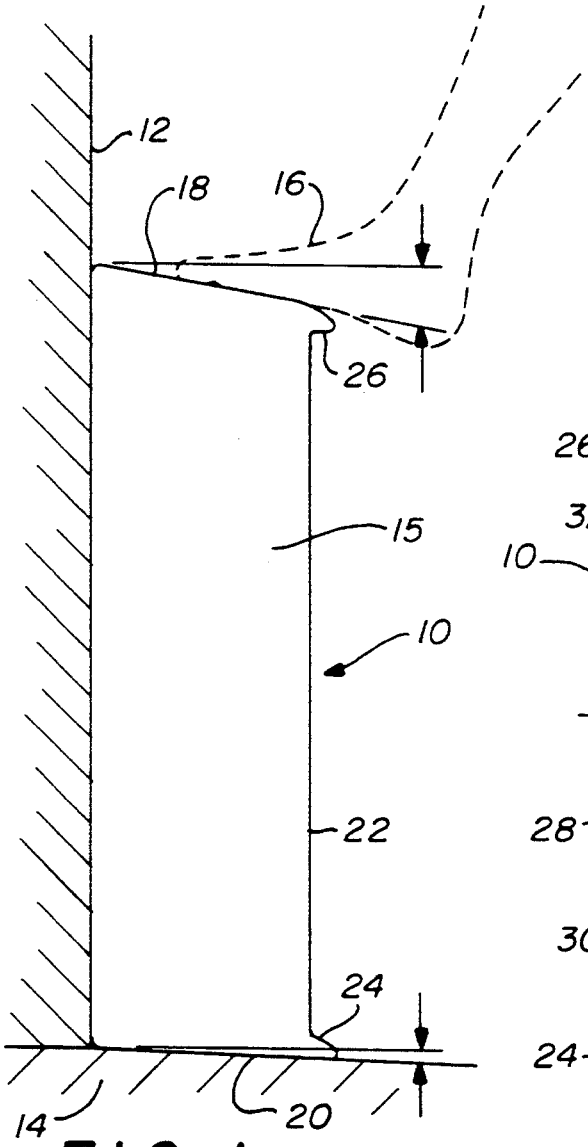
FIG. 1 is a schematic diagram showing the present invention placed in the corner of a shower stall with a user's foot resting thereon.

FIG. 1 shows a schematic diagram of a preferred embodiment of the present invention 10 placed in the corner of a shower stall and resting against a wall 12 and floor 14. A user's foot 16 is shown resting on the foot rest 10, which is preferably formed of molded plastic.

Advantageously, as seen in FIG. 1, foot rest 10 includes a downward sloping bottom section 20 which conforms to the slope of the shower floor 14. In this way an elongated body portion 15 having a general cross-sectional shape of a right-angle triangle of the foot rest 10 stands perpendicular to horizontal when placed in the shower stall. Furthermore, a top section 18 of the foot rest 10 also slopes downwardly to provide for the comfortable placement of the user's foot 16. The slope of the bottom section 20 is preferably approximately one-quarter inch per foot and the slope of the top section 18 is approximately 10 degrees.

A portion of the bottom section 20 advantageously extends beyond a front wall 22 of foot rest 10, thereby forming a bottom lip 24 for providing additional support to the foot rest 10.

Preferably, a portion of the top section 18 also extends beyond front wall 22 thereby forming an overhanging lip 26 which functions as a handle when a user lifts foot rest 10.

Figure 2:
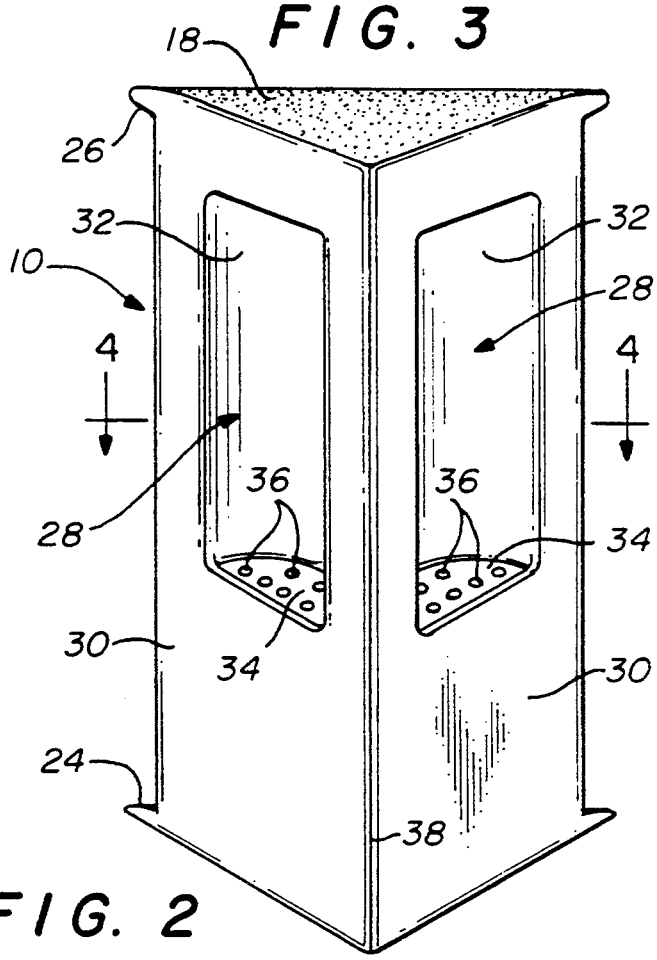
FIG. 2 is a perspective view of the foot support from the rear.
Figure 4:
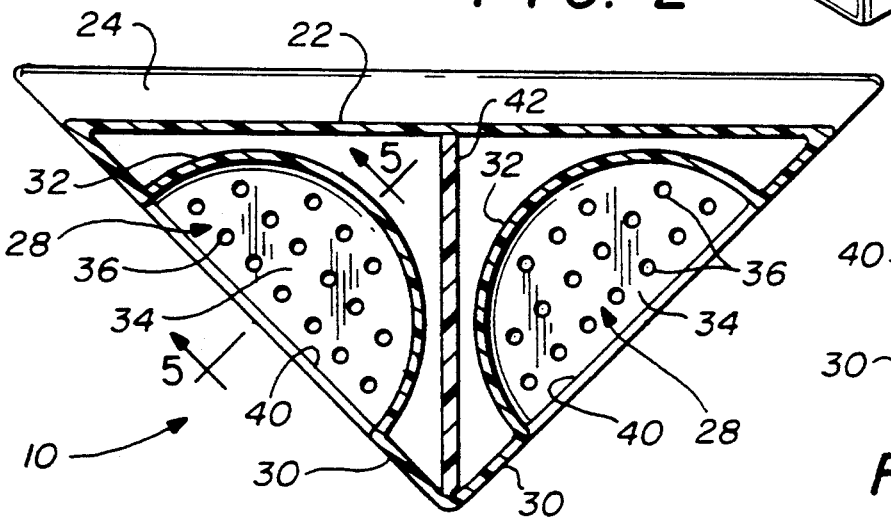
FIG. 4 is a section view of the present invention taken along line 4—4 of FIG. 2.
Figure 5:
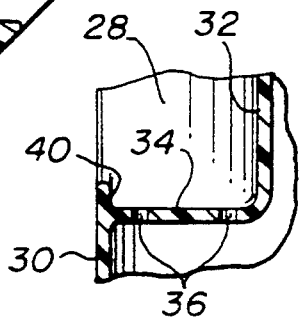
FIG. 5 is a fragmentary section of the present invention taken along line 5—5 of FIG. 4.

A user will lift foot rest 10 using lip 26 in order to gain access to shelf units 28, shown in FIG. 2. Shelf units 28 are, preferably, integral to back walls 30, as shown in FIG. 5, and include curved side walls 32 and shelf portion 34. Preferably, shelf portion 34 includes drainage holes 36 which allows any excess moisture to drain away from the shelf unit 28 and on to floor 14. Back walls 30 combine to form a right angle defined by an edge 38, as best seen in FIG. 4, and together with front wall 22 form elongated body portion 15 with front wall 22 forming the hypotenuse of the triangular cross section. In use, edge 38 is then placed in a corner of a shower stall where, because of the slope of the bottom section 20, back walls 30 will stand essentially parallel to walls 12 of the shower stall.

Preferably, a portion of each back wall 30 forms a lip 40 which assists in retaining any toiletry articles which may be placed in shelf units 28.

Figure 3:
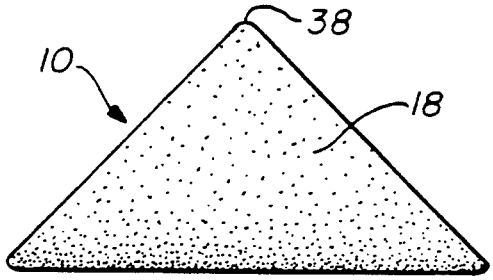
FIG. 3 is a top view of the present invention.

As shown in FIG. 3, top section 18 preferably is a nonslip surface such as the pebbled surface shown. Though a pebbled surface has been shown, it should be understood that any nonslip surface such as one of raised ridges or an inlaid lattice pattern would also be appropriate.

Finally, as shown in FIG. 4, foot rest 10 preferably includes an integral central structural support member 42 which runs the length of foot rest 10 for providing additional strength thereto.

The foot rest 10 is, preferably, about 18 inches in height and when placed in the corner of a shower stall the top section 18 is sloped downwardly towards a user at approximately ten degrees. The slope of the top section 18 enables a user to comfortably and securely place her foot 16 thereon to assist her while bathing. Also, because foot rest 10 is formed of molded plastic, it is very lightweight and may easily be lifted by lip 26 to gain access to toiletry items which can be conveniently stored out of sight in shelf units 28.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A foot rest comprising:

an elongated generally triangular shaped body portion, said body portion being formed by two connected back walls which together form a right angle and a front wall connected to each of the two back walls forming a hypotenuse of said body portion;

a bottommost generally triangular shaped section integral to said body portion and flush with respect to said back walls, said bottommost section sloping downwardly from said right angle to said front wall at essentially the same slope as a floor of a shower stall such that said back walls are generally parallel to walls of a shower stall when said foot rest is placed in a corner of the shower stall;

a topmost generally triangular shaped, essentially planar section integral to said body portion and flush with respect to said back walls and extending beyond said front wall, said planar section sloping downwardly from said right angle to said front wall for providing a user with a foot rest while taking a shower; and a pair of integral shelf units formed within said body portion and accessible through corresponding apertures defined within each of said back walls for storage of supplies in said shelf units.

2. The foot rest of claim 1 wherein said bottommost section extends beyond said front wall for providing additional support to said body portion.

3. The foot rest of claim 2 wherein said foot rest is formed of molded plastic.

4. The foot rest of claim 1 wherein said bottommost section has a slope of approximately one-fourth of an inch per foot.

5. The foot rest of claim 1 wherein said topmost section has a slope of approximately ten degrees.

6. The foot rest of claim 1 wherein said topmost section presents an upper nonskid surface for providing traction for a user's foot.

* * * * *